US011994372B2

(12) United States Patent
Dergunov

(10) Patent No.: US 11,994,372 B2
(45) Date of Patent: May 28, 2024

(54) POUCH FOR CARRYING FIREARM MAGAZINES

(71) Applicant: Dmytro Valeriiovych Dergunov, Odeska Oblast (UA)

(72) Inventor: Dmytro Valeriiovych Dergunov, Odeska Oblast (UA)

( * ) Notice: Subject to any disclaimer, the term of this patent is extended or adjusted under 35 U.S.C. 154(b) by 13 days.

(21) Appl. No.: 17/460,683

(22) Filed: Aug. 30, 2021

(65) Prior Publication Data

US 2022/0065603 A1 Mar. 3, 2022

(30) Foreign Application Priority Data

Aug. 31, 2020 (GB) ..... u 2020 05593

(51) Int. Cl.
*A45F 3/06* (2006.01)
*A45F 5/00* (2006.01)
*F42B 39/02* (2006.01)

(52) U.S. Cl.
CPC ..... *F42B 39/02* (2013.01); *A45F 5/00* (2013.01); *A45F 2200/0591* (2013.01)

(58) Field of Classification Search
CPC ..... A45F 3/06; A45F 2200/0591; A45F 5/02; A45F 5/021; A45F 2003/003; F42B 39/02; F42B 39/26; B65D 21/08; A45C 7/0063
USPC ..... 224/931
See application file for complete search history.

(56) References Cited

U.S. PATENT DOCUMENTS

| | | | | |
|---|---|---|---|---|
| 6,547,070 | B1 * | 4/2003 | Kolpin | F41C 33/06 190/110 |
| 9,759,536 | B2 * | 9/2017 | Gadams | B65D 63/10 |
| 10,352,652 | B2 * | 7/2019 | Higdon, Jr. | F41C 33/0236 |
| 10,835,005 | B2 * | 11/2020 | Buerck | A45C 13/1046 |
| 10,928,172 | B1 * | 2/2021 | Mironski | F42B 39/02 |

(Continued)

FOREIGN PATENT DOCUMENTS

| | | |
|---|---|---|
| RU | 188151 | 4/2019 |
| UA | 125148 | 4/2018 |
| UA | 135455 | 6/2019 |

*Primary Examiner* — Adam J Waggenspack
(74) *Attorney, Agent, or Firm* — Defillo & Associates, Inc; Evelyn A. Defillo

(57) ABSTRACT

The invention relates to the field of weapons, especially a device for wearing or carrying ammunition (magazines with cartridges or empty magazines) for small arms such as pistols, rifles, automatic rifles, automatic weapon, light machine guns, etc., and to design pouches formed open-faced to dispose magazines for cartridges. The pouch includes longitudinal and transverse walls and a waterproof material bottom and configured to form the open-faced pouch housing. Also, elements for attaching the housing to ammunition, the elements including at least one band fixed in the openings of the housing and ammunition. At least one of the longitudinal walls, the transverse walls and the bottom of the housing are formed solid-drawn (from a single piece of material), while the elements for attaching the firearm magazines pouch housing to the ammunition and also the elements for fastening a pistol magazine pouch housing on the above said firearm magazines pouch housing are made with the possibility of being partially arranged in the inner cavity of the above said firearm magazines pouch housing or the above said pistol magazine pouch housing.

6 Claims, 5 Drawing Sheets

(56) References Cited

U.S. PATENT DOCUMENTS

| | | | | |
|---|---|---|---|---|
| 11,033,095 | B1 * | 6/2021 | VanHeusen | A45F 5/00 |
| 2011/0017624 | A1 * | 1/2011 | Robertson | A45C 13/02 206/438 |

* cited by examiner

POUCH FOR CARRYING FIREARM MAGAZINES

FIELD OF THE INVENTION

The invention relates to the field of weapons, in particular to means for wearing or carrying ammunition (magazines with cartridges or empty magazines) for small arms such as pistols, rifles, automatic rifles, automatic weapon, light machine guns, etc., and can be used to design pouches formed open-faced to dispose magazines for cartridges.

BACKGROUND OF THE ART

There is known a pouch comprising top parts including front and rear walls, botan, and folds, and a zipper, while the top parts are made of a waterproof textile material and have rectangular shapes. On the perimeters, they are stitched with ribbons for hanging various modules or items. The zipper is located along the front rectangular wall [UA No. 125148 U, A45C 3/08, A45C 9/00, 2018].

This design of the pouch cannot be used as an open-faced pouch to dispose a magazine for cartridges, and the product does not provide improving the strength, safety, reliability and good maintenance of the magazine with cartridges in the pouch. Such a pouch is laborious due to the need to manufacture and connect lots of separate parts.

It is known a pouch designed for carrying grenades disposed therein and for removing those therefrom by a person with his one hand. The pouch comprises a hollow container provided with a hinged valve, the container including a metal base to upkeep maintaining grenades, and also a connecting wire with its one end being attached to the metal base, and with its other end being attached to a transporting pin configured to be located into a grenade instead of a tab. The metal base is made in the form of a single piece, which is cut from a flat metal sheet and formed to have side walls provided with bends in the upper portion thereof to upkeep maintaining a grenade spherical surface. The metal base also has its upper and lower protrusions adapted to provide fitting a grenade without backlash, and also with reliably fastening thereof, as well as a down stop to provide for the grenade base retention. [RU No. 188 151 U1, F41C 33/06, 2019].

However, such a design of the pouch includes a fairly large number of metal parts having rather heavy weight, which fact reduces the amount of payload carried. In addition, the specified pouch is laborious to manufacture due to the need to execute and connect lots of individual parts.

There is known a pouch formed open-faced to dispose a magazine for cartridges, which comprises component parts made of waterproof material and connected to each other, namely: a front wall, a rear wall, two side walls, and a bottom, which form the open-faced pouch common housing, while on the outer side of the front wall, there are arranged the fixed horizontal belts to form the front spatial slots (cells, cells of the MOLLE system type) between the outer side of the front wall and the horizontal belts, and on the outer side of the rear wall, there are also located the fixed horizontal belts to form the rear spatial slots (cells, cells of the type MOLLE systems) between the outer side of the rear wall and the horizontal belts, while in the upper portion of the rear wall of the housing, there is attached at least one vertical belt, which is fastened to the upper portion of the rear wall with the use of the horizontal belts and the rear spatial slots (cells, cells of the MOLLE system type). All-around the housing, there is a round elastic rubber band made with the possibility of tightening/stretching. The above said band is inserted and pulled through the front and rear spatial slots (cells, cells of the MOLLE system) in such a way that the round elastic rubber band tightens the front wall, the rear wall and the two side walls together. Each of the above two side walls is formed as a separate side panel, and each of the above two separate side panels has corresponding openings for pulling the round elastic rubber band there through, and the above said round elastic rubber band is inserted and pulled through the corresponding openings of each of the two separate side panels so that it evenly tightens the front wall, the rear wall, and the two side walls, which are made in the form of two separate side panels, together [UA No. 135455 U, F41C 33/00, F41C 33/06, 2019].

The specified pouch is a labour-intensive product because of the need to manufacture and connect a lot of individual parts, and it is also quite heavy, which reduces the amount of payload carried.

The closest technical solution to the claimed invention is a pouch for carrying firearm magazines, which is made in the form of a device for the secure stowing of a magazine, comprising:

- a housing bounded by:
- a first pair of opposing side walls having substantially the same height;
- a second pair of opposing side walls, wherein the second pair of opposing side walls is of substantially the same height, the first pair of opposing side walls being in substantially perpendicular plane to the second pair of opposing side walls, and the first pair of opposing side walls being shorter in height than the second pair of opposing side walls:
- bottom wall (bottom) and top opening:
- biasing means whereby at least one pair of opposing side walls are biased toward one another
- means of attachment whereby the housing may be attached to a person or object.

[U.S. Pat. No. 9,759,536, IPC: F42B 39/00, F42B 39/02, B65D 25/04, B65D 25/20, B65D 63/10, Jul. 1, 2016].

The indicated pouch, like the previous analogs, is laborious to manufacture due to the need to produce and connect lots of individual parts, and it is also quite heavy, which reduces the amount of payload carried.

SUMMARY OF THE INVENTION

The invention is based on the technical problem of improving the pouch for carrying firearm magazines to reduce the labor intensity of its manufacture and decrease the weight in order to be able to carry a larger amount of payload.

The problem is solved by the tact that in a pouch for carrying firearm magazines comprising longitudinal and transverse walls and a bottom made of a waterproof material and configured to form the open-faced pouch housing, and also elements for attaching the housing to ammunition, with those elements including at least one band fixed in the holes(openings) of the housing and ammunition, according to the invention, at least one of the longitudinal walls, the transverse walls and the bottom of the housing are formed solid-drawn from a single piece of material, while the elements for attaching the above said firearm magazines pouch housing to the ammunition and also the elements for fastening such a product as a pistol magazine pouch housing on the above said firearm magazines pouch housing are made with the possibility of being partially arranged in the inner cavity of the above said firearm magazines pouch housing or the above said product as a pistol magazine pouch housing.

Polymeric materials can be used as the housing materials.

The front longitudinal wall can be provided with an elastic pad and fastened to the transverse walls.

The front longitudinal wall can be made of elastic band and fastened to the transverse walls.

An attachment of a transverse wall and a front longitudinal wall of the pouch housing can be made seamed.

An attachment of a transverse wall and a front longitudinal wall of the pouch housing can be made laced, and the openings for lacing and the openings for the attachment system can be made cut into the material, or cast, or sewn on.

The pouch front longitudinal wall can be provided with additional openings for attaching the pistol magazine pouch thereon.

On the pouch front longitudinal wall, there can be fixed an additional pad made of plastic or fabric for attaching the pistol magazine pouch thereto.

The elements for attaching the pouch housing to the ammunition and the attachment for the pistol magazine pouch housing on the above said pouch housing are made with the possibility of being partially arranged in the inner cavity of the above said pouch housing or the above said pistol magazine pouch housing.

The fact that at least one of the longitudinal walls, the transverse walls and the bottom of the pouch housing are formed solid-drawn from a single piece of plastic with openings contributes to the achievement of a small weight for the specified class of products, namely, −2.5 times lower than for the prototype, which allows the user to carry more payload, and not the packaging itself. In particular, the automatic weapon pouch weighs 34 g, and the weight of the pistol pouch is 18 g.

There has been significantly simplified the process of the product manufacture. Since most of work is performed by automatic stamping of the housing portion of the design structure, the number of sewing operations has been substantially reduced.

The fact that the product attaching and fastening system, the elements of which are made with the possibility of being partially arranged in the inner cavity of a pouch housing credits the system with the feature of not only fastening, but also providing a non-slip layer for more reliable fixation.

BRIEF DESCRIPTION OF THE DRAWINGS

The invention is illustrated by the following figures.

DETAILED DESCRIPTION OF THE INVENTION

Figure 1:
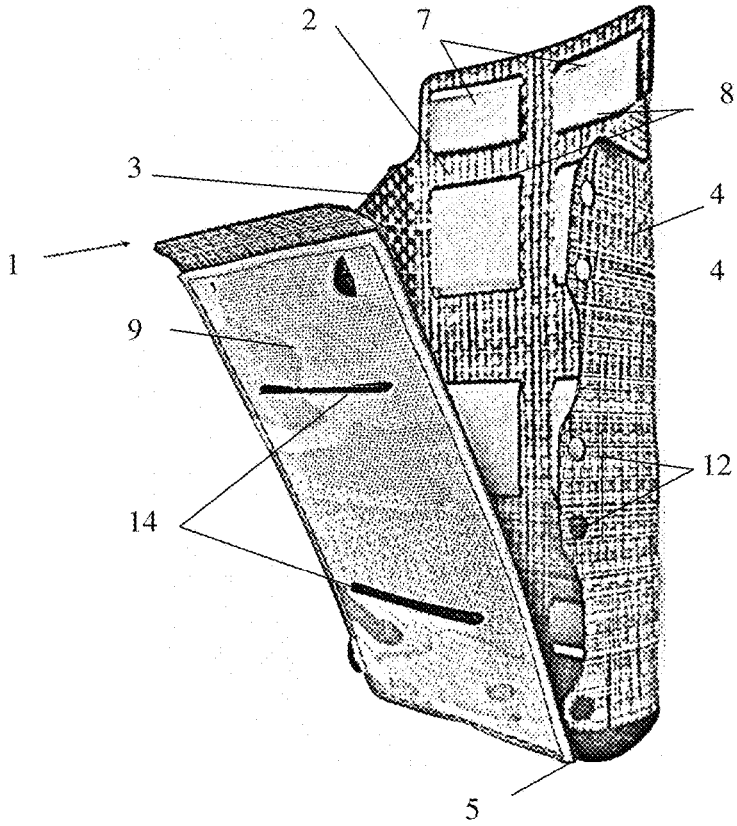
FIG. 1 shows a general view of the pouch.
Figure 2:
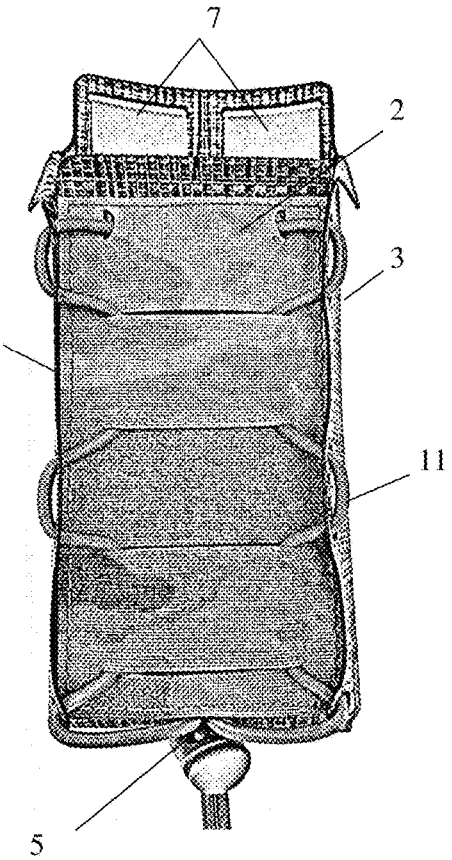
FIG. 2 shows the pouch from the rear longitudinal side.
Figure 3:
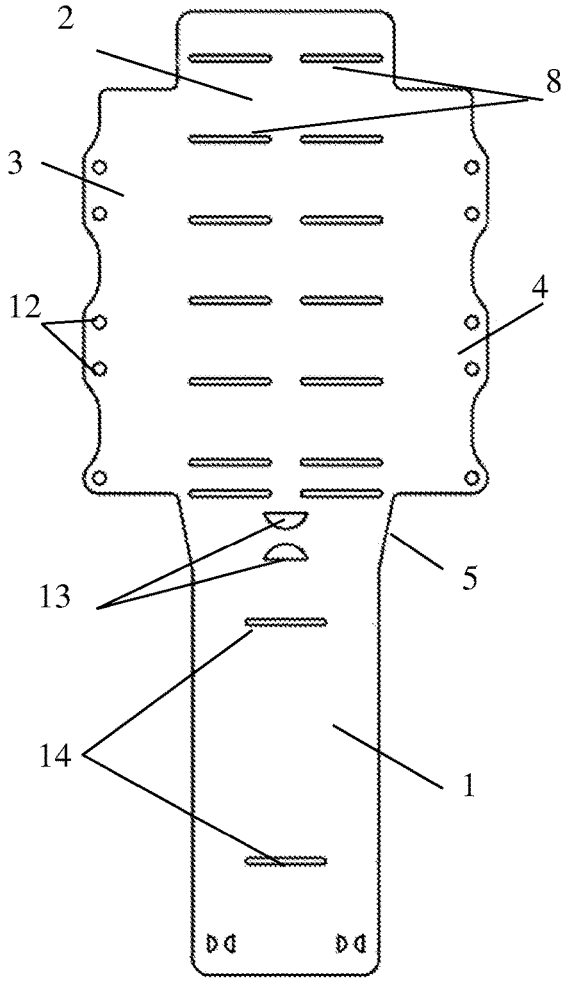
FIG. 3 shows a developed view of the pouch housing with openings for fastening.
Figure 4:
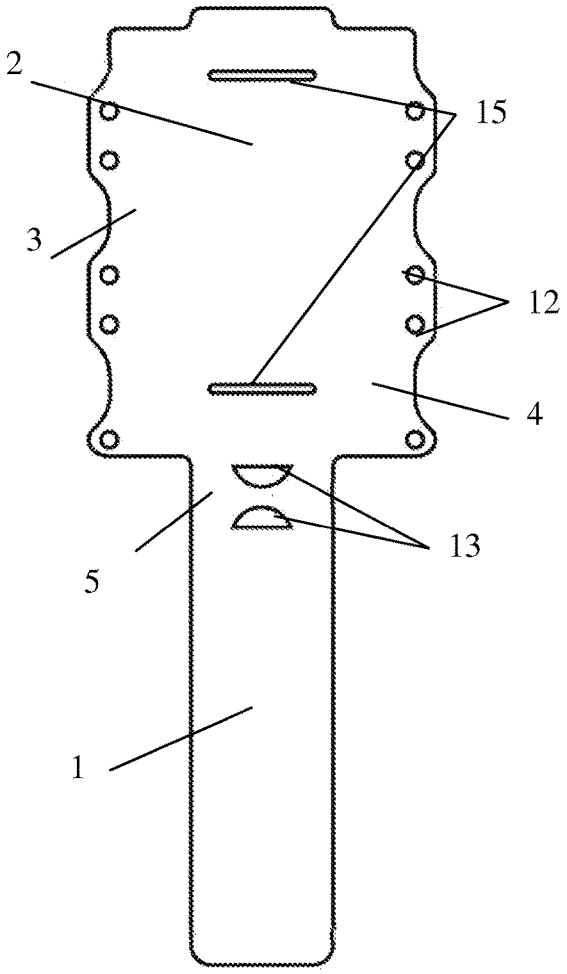
FIG. 4 shows a developed view of the pistol magazine pouch housing with openings for fastening.
Figure 5:
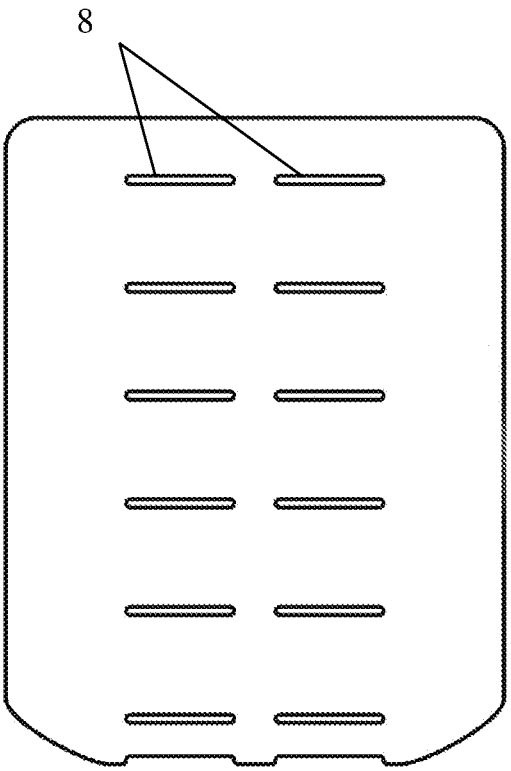
FIG. 5 shows a developed view of the system for attaching the pouch to the ammunition.
Figure 6:
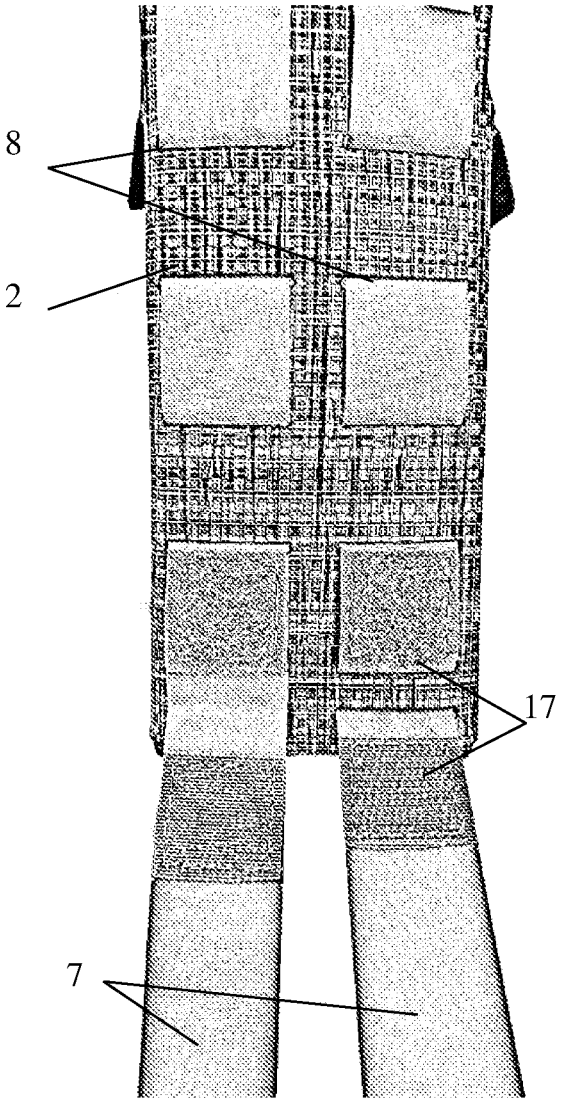
FIG. 6 shows a system for attaching and fixing the pouch to a textile fastener of the Velcro type.
Figure 7:
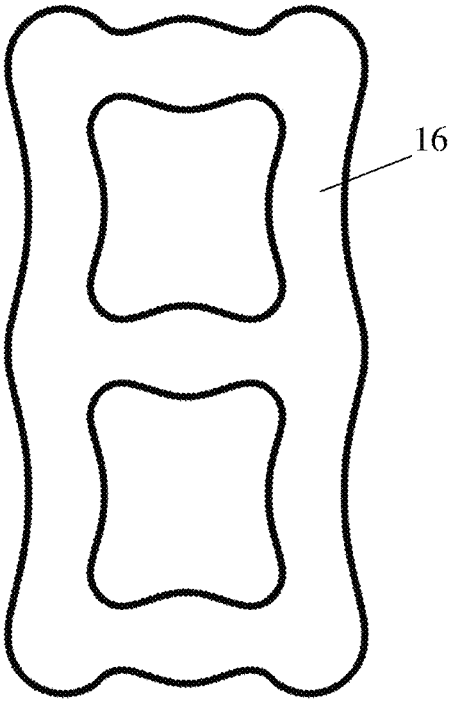
FIG. 7 shows a pad made of plastic or fabric for attachment to a pistol magazine pouch.
Figure 8:
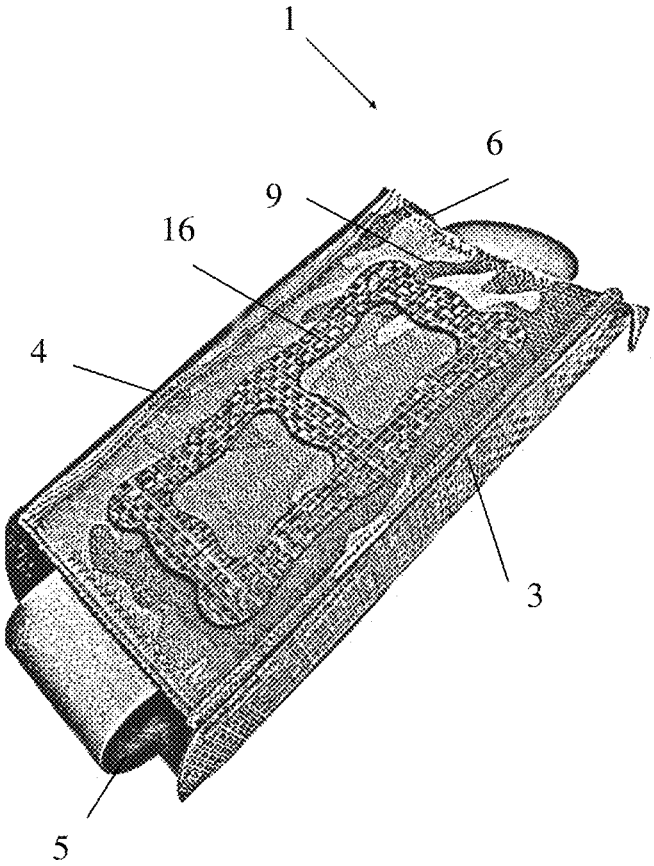
FIG. 8 shows the pad attachment of the pistol magazine pouch on the front longitudinal wall of the main pouch.
Figure 9:
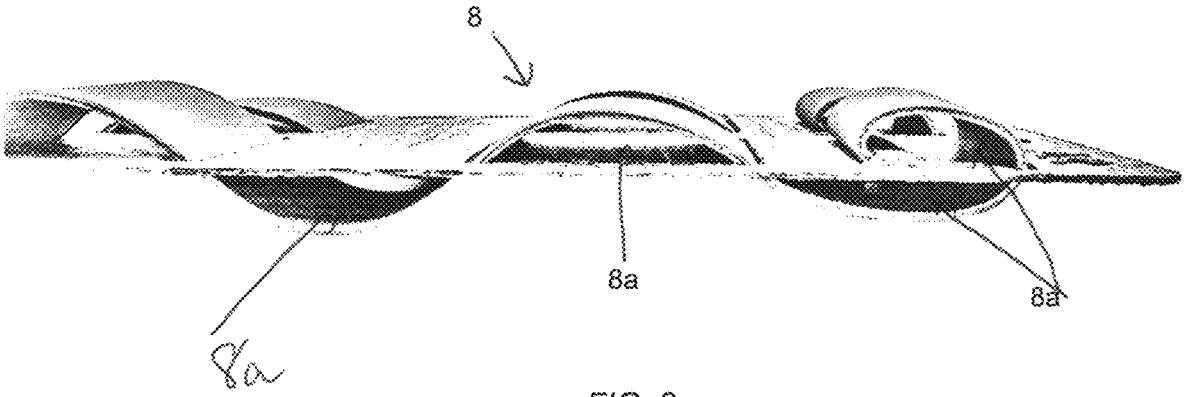
FIG. 9 shows the ammunition attaching elements including inner compartments adapted to receive at least one piece of ammunition.

The pouch for carrying firearm magazines comprises longitudinal walls made of waterproof material, namely, front 1 longitudinal wall and rear 2 longitudinal wall, and transverse side walls 3, 4, bottom 5, those forming the housing of the pouch with open-face 6, and the ammunition attaching elements 8, at least, one band 7 fixed in opening (not shown) of the housing and in the corresponding openings of the ammunition attaching element 8, while one of longitudinal walls 1, 2, transverse walls 2, 3 and bottom 5 of the housing are formed from a single piece of material, wherein the elements for attaching the housing of the pouch to the ammunition and the attachments for fastening the pistol magazine pouch housing on the main pouch housing are made with the possibility of being partially arranged in the inner cavity of the above said main pouch housing or the above said pistol magazine pouch housing.

Each one of the ammunition attaching elements 8 include inner compartments 8*a* adapted to receive at least one piece of ammunition (not shown). Each one of the ammunition attaching elements 8 is located on an inner side of the rear longitudinal wall inside the housing (See FIG. 1). Each one of the ammunition attaching elements 8 fit into the inner cavity of the housing.

Front 1 longitudinal wall can be provided with elastic pad 9 and fastened with transverse side walls 3, 4 by seam 10.

The front longitudinal wall 2 can be made of an elastic band and fastened to transverse side walls 3, 4 by means of seam 10.

Attaching of transverse side walls 3, 4 and front longitudinal wall 1 with each other, as a result, can also be made by lacing using elastic cord 11, and the openings 12, 13 for lacing and openings 8 of the attachment system can be made by cutting in the material, or by casting, or by sewing on.

In addition, in front 1 longitudinal wall of the pouch, there can be provided additional openings 14 for attaching the pistol magazine pouch thereon and in rear 2 longitudinal wall of the pistol magazine pouch, there can be provided corresponding openings 15.

On the front 1 longitudinal wall (with or without elastic pad 9), additional pad 16 made of plastic or fabric can be attached to fasten a pistol magazine pouch or a second cartridge magazine pouch. The elements for fastening the housing to the ammunition or attaching the pistol magazine pouch can be made with the possibility of being partially arranged in the inner cavity of the housing and fixed with the use of a textile fastener of the Velcro 17 type.

As a housing material there can be used a plastic based on synthetic or natural polymers with appropriate tillers, plasticizers and, if necessary, other special additives that provide the plastic with certain properties, in particular, increased resistance to mechanical and thermal influences.

The pouch functions as follows.

The pouch for carrying firearm magazines is used to wear or carry magazines with cartridges or empty magazines for such small arms as: pistols, rifles, automatic rifles, machine guns, light machine guns, etc. The magazine is inserted (and withdrawn for use) through the upper open-faced part 6 in the pouch housing. In some cases of the invention, the pouch housing can be made of two parts, that is, a pouch for a pistol magazine can be attached thereto, or it can be configured to be used with two magazines for cartridges.

The pouch is attached to the user's ammunition elements using band 7, which can be elastic, and which is fed through a sling on the body armor in a staggered manner and brought back to the inside of the pouch, then fed again also in a snaking staggered manner through the sling on the body armor and the end of the band 7 is run under the pouch.

When used, the cartridge magazine pouch allows achieving the claimed technical result, namely, to provide for an increase in the service life and the use of the entire product as a whole; improve the strength and maintenance reliability of the magazine with cartridges in the pouch; facilitate and speed up the installation of a magazine for cartridges in the pouch.

The claimed pouch for magazines for cartridges can be factory fabricated. Its experimental and combat tests have been carried out, and those showed the industrial applicability of the invention.

The invention claimed is:

1. A pouch for carrying firearm magazines comprising:

a housing having a front longitudinal wall, a rear longitudinal wall, transverse side walls, a bottom end made of a waterproof material; and an open-faced top end, the front longitudinal wall, the rear longitudinal wall, the transverse side walls, and the bottom end form an inner cavity;

at least one ammunition attaching element having inner compartments adapted to receive at least one piece of ammunition, the at least one ammunition attaching element is located on an inner side of the rear longitudinal wall inside the housing, each one of the ammunition attaching elements including at least one band fixed in an opening of the housing;

an elastic pad connected to an outer side of the front longitudinal wall;

wherein the front and rear longitudinal walls, the transverse side walls, and the bottom end of the housing are made from a single piece of material, wherein the at least one ammunition attaching element fits into the inner cavity of the housing.

2. The pouch according to claim 1, wherein the housing is made of a polymeric material.

3. The pouch according to claim 1, wherein the front longitudinal wall, the rear longitudinal wall, and the transverse side walls are connected by an elastic cord.

4. The pouch according to claim 1, wherein the front longitudinal wall, the rear longitudinal wall, and the transverse side walls are connected by a seam.

5. The pouch according to claim 1, wherein the front longitudinal wall further includes additional openings.

6. A pouch for carrying firearm magazines comprising:

a housing having a front longitudinal wall, a rear longitudinal wall, transverse side walls, a bottom end made of a waterproof material; and an open-faced top end, the front longitudinal wall, the rear longitudinal wall, the transverse side walls, and the bottom end forms an inner cavity;

at least one ammunition attaching element having inner compartments adapted to receive at least one piece of ammunition, the at least one ammunition attaching element is located on an inner side of the rear longitudinal wall inside the housing, each one of the ammunition attaching elements including at least one band fixed in an opening of the housing;

an elastic pad connected to an outer side of the front longitudinal wall;

wherein the front and rear longitudinal walls, the transverse side walls, and the bottom end of the housing are made from a single piece of material, wherein the at least one ammunition attaching element fits into the inner cavity of the housing, wherein the front longitudinal wall further includes a second pad attached to the elastic pad, the second pad includes at least one central opening and is made of plastic or fabric.

* * * * *